United States Patent [19]

McLellan

[11] Patent Number: 4,603,289

[45] Date of Patent: Jul. 29, 1986

[54] DUAL INPUT VOLTAGE REGULATOR

[76] Inventor: Norvel J. McLellan, 1002 N. Main St., Pleasanton, Tex. 78064

[21] Appl. No.: 636,623

[22] Filed: Aug. 1, 1984

[51] Int. Cl.[4] ..... G05F 1/567; G05F 1/573

[52] U.S. Cl. ..... 323/277; 323/231

[58] Field of Search ..... 323/273–281, 323/349, 231

[56] References Cited

U.S. PATENT DOCUMENTS

| | | | |
|---|---|---|---|
| 2,824,276 | 2/1958 | Stump | 323/312 |
| 3,101,441 | 8/1963 | Curry | 323/278 |
| 3,373,341 | 3/1968 | Wattson | 323/277 |
| 3,386,030 | 5/1968 | Kann | 323/311 |
| 3,916,294 | 10/1975 | Kennedy | 323/275 |

FOREIGN PATENT DOCUMENTS

| | | | |
|---|---|---|---|
| 778919 | 2/1968 | Canada | 323/275 |
| 957729 | 11/1974 | Canada | 323/273 |
| 1189183 | 3/1965 | Fed. Rep. of Germany | 323/231 |

*Primary Examiner*—William H. Beha, Jr.

[57] ABSTRACT

The invention is a dual input voltage regulator that has four active parts: a transistor, a resistor, a zener diode and a capacitor. It has one input for main power and one input for turn on power. The dual input allows lower main input voltage and allows the regulator to be synchronized with load.

3 Claims, 1 Drawing Figure

DUAL INPUT VOLTAGE REGULATOR

BACKGROUND

The basic advantage of dual input power is to get good regulation with few parts and to allow the regulator to be synchronized with load current so the small ripple of the regulator is not noticed in the output of what the regulator powers.

SUMMARY

The objective of the invention is to provide a regulated power supply that is stable, has few parts, and has low turn on surge current.

DESCRIPTION OF DRAWING

The sole FIGURE is a schematic diagram of the invention showing the 4 basic active parts, part numbers 1 through 4, plus other parts that can be included when good temperature stability and/or over current protection is desired.

DESCRIPTION OF INVENTION

Figure 1:
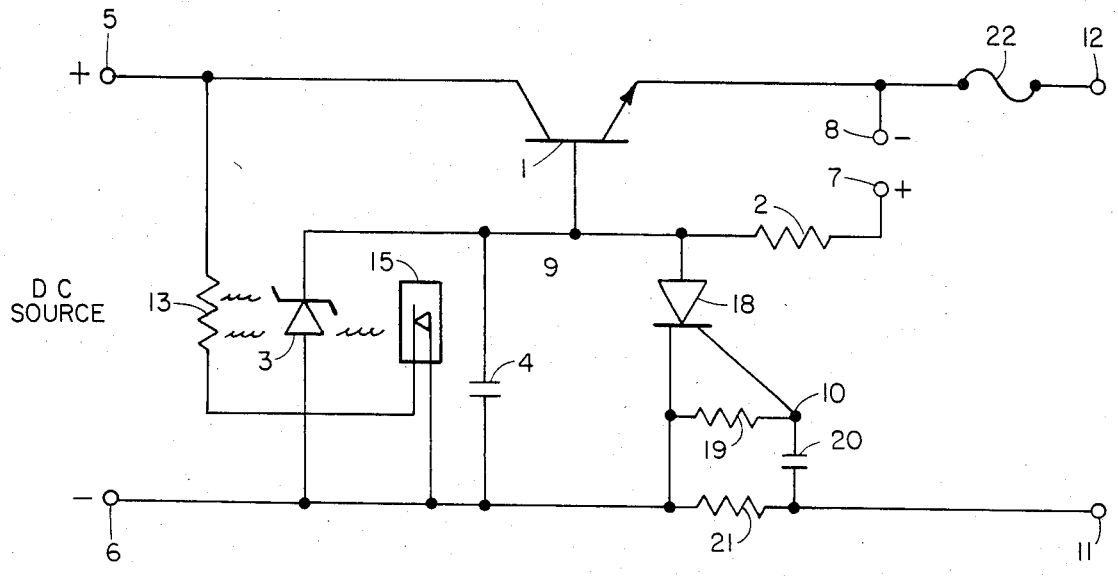

Refering to the sole FIGURE, part 1 is a power transistor, part 2 is a base current limiting resistor of transistor 1, part 3 is a zener diode that clamps the base of transistor 1 at its zener voltage, part 4 is a filter capacitor, parts 5,6,7,8,9,10,11 and 12 are connection terminals, part 13 is a heating element that keeps zener 3 warm to prevent output voltage drift due to temperature change, and part 15 is a thermostat for temperature control of zener 3. Zener 3, heater 13 and thermostat 15 have close thermal coupling. Part 18 is an SCR for over-current protection, part 19 is a gate bypass resistor of SCR 18, part 20 is a high surge-current coupling capacitor to the gate of SCR 18, and part 21 is a load sampling resistor. Part 22 is a fuse.

Operation: With 5 and 6 connected to a DC power source and 7 and 8 connected to a DC power source, current through resistor 2 and base-emitter of transistor causes current to flow through transistor 1. This raises the voltage at the emitter of transistor 1. This voltage is added to voltage at terminals 8 and 7 and charges capacitor 4 until zener 3 breaks over and clamps the base voltage of transistor 1 to this break over voltage. This holds the voltage at emitter of transistor 1 to app. 0.7 volts lower than its base voltage.

Heater 13 and thermostat 15 controls the temperature of zener 3. Without temperature control the voltage at emitter of transistor rises app. 3 volts during warm up. Parts 18, 19,20 and 21 provide protection for sudden increases in load current. Slow increases in load current will not be passed by capacitor 20. Fuse 22 is protection for slow increases in load current.

Terminal 5 is positive and terminal 6 is negative input from main power source. Terminal 7 is positive and terminal 8 is negative from the power source that turns the regulator on. Terminal 9 is the base connection terminal. Terminal 10 is the SCR gate connection terminal. Terminal 11 is the negative output connection terminal. Terminal 12 is the positive output connection terminal. "Basic active parts" are the parts that involved in the regulation of the output voltage instant to instant.

I claim:

1. A dual input voltage regulator comprising:

input terminal means for connection to a DC voltage supply, output terminal means for connection to a load, regulating means interposed between said input and output terminal means for regulating an output voltage supplied to said output terminal means, said regulating means including:

a transistor having an emitter, a collector and a base electrode, power bias terminal means coupled between said base and emitter terminals, resistive means coupled in series with said bias terminal means, zener diode means coupled between one of said input and output terminal means and said transistor base electrode, a capacitor connected in parallel with said zener diode means, temperature control means associated with said zener diode means to maintain the temperature of said zener diode means substantially constant, said temperature control means comprising a heater and a thermostat series connected across said input terminal means.

2. The dual input voltage regulator of claim 1 further comprising overcurrent protection means coupled between a common one of said input and output terminals and said transistor base electrode.

3. The dual input voltage regulator of claim 2, wherein said over current protection means comprises thyristor means having an anode, a cathode and a gate, said anode connected to said transistor base electrode, said cathode connected to one of said input terminals, current sensing resistance means coupled in series between said one of said input and output terminals and thyristor gating means coupled between said current sensing resistance means and said gate electrode for gating said thyristor means upon the occurance of an overcurrent.

* * * * *